US006561830B1

(12) United States Patent
Yanovsky et al.

(10) Patent No.: US 6,561,830 B1
(45) Date of Patent: May 13, 2003

(54) ELECTRICAL PLUG RECEPTACLE WITH RELEASABLE CATCH MECHANISM

(76) Inventors: Vladislav Yanovsky, 14 Marie Ave., Sharon, MA (US) 02067; Anatoliy Sirota, 81 Hackensack Rd., West Roxbury, MA (US) 02467

( * ) Notice: Subject to any disclaimer, the term of this patent is extended or adjusted under 35 U.S.C. 154(b) by 0 days.

(21) Appl. No.: 10/073,441

(22) Filed: Feb. 11, 2002

(65) Prior Publication Data

(65)

(51) Int. Cl.[7] ..... H01R 13/15
(52) U.S. Cl. ..... 439/263
(58) Field of Search ..... 439/346, 263, 439/259

(56) References Cited

U.S. PATENT DOCUMENTS 4,846,707 A * 7/1989 Pirkle ..... 439/263
4,909,749 A * 3/1990 Long ..... 439/263
5,170,117 A * 12/1992 Chio ..... 439/263
6,244,885 B1 * 6/2001 Iwahori ..... 439/263

* cited by examiner

*Primary Examiner*—Gary Paumen
(74) *Attorney, Agent, or Firm*—William Nitkin

(57) ABSTRACT

A plug receptacle is disclosed which includes structure in a first mode to apply lateral pressure against a plug prong to retain such prong in the receptacle and in a second mode such structure is moved in a way to cease applying pressure against such prong to allow the prong and plug to be removed from the receptacle.

2 Claims, 2 Drawing Sheets

36A
56
36
54
50
52
48
28
32A
34
32
26
10
44
22A
24
20
22
12
38
18
16
14
30

ELECTRICAL PLUG RECEPTACLE WITH RELEASABLE CATCH MECHANISM

BACKGROUND OF THE INVENTION

1. Field of the Invention

This invention relates to locking electrical plug receptacles and more particularly relates to a locking plug receptacle with easy-to-use plug release means.

2. Description of the Prior Art

A number of female electrical plug receptacles have been developed for use with 110 volt two-prong or three-prong electrical plugs. Plugs are freely insertable and removable from such receptacles. Inadvertent unplugging, though, can cause an undesired loss of power. Further, a receptacle without a plug therein is exposed, and its electrical contacts can be touched by young children who may be injured by shocks therefrom. It is therefore desirable to provide a releasable lock that is reliable and safe to securely hold the plug to the plug receptacle until it is desired to deliberately unlock the plug and remove it from the receptacle. Many inventions have been made in the field of releasable lock mechanisms for plugs. The usage of such plug-locking receptacles is known for use in both wall sockets and extension cords. Most male plugs typically have either a small ⅛ inch diameter hole or a tab near the end of each prong, or a notch or hook on one or more sides of each prong for locking purposes. The prior art includes a variety of examples of how these holes, tabs, notches and hook-shaped elements on the plug prongs may be locked onto and engaged by a plug receptacle, such as taught in U.S. Pat. No. 4,319,797 to Otani et al.; U.S. Pat. No. 4,932,886 to Glaser; U.S. Pat. No. 5,286,213 to Altergott et al.; and U.S. Pat. No. 5,921,799 to Forrester.

The problem with much of the prior art is that the male prongs must be of a specific size or shape to be utilized with a specific locking receptacle. Further, such locking receptacles can become inoperative due to wear of its aligning or directing surfaces, especially when used with somewhat bent or excessively worn plug prongs. Some receptacles with locking mechanisms require not only proper alignment of the prong plug elements, but also further movement and engagement of the locking assemblies in the plug receptacle. Another problem seen in the prior art is that many locking mechanisms of the plug receptacles have control lock parts arranged or protruding from the side of the receptacle which design renders these mechanisms difficult to use for extension cords where a receptacle with an attached plug and cord may need to be dragged across the ground, the floor, over obstacles and the like; and such protruding parts could become caught or entangled.

Another problem found in the prior art is that many receptacle locking mechanisms take some time to interconnect them with the male prongs which situation renders them impractical for widespread use.

Further, a wide range of receptacle locking mechanisms are not hermetically sealed and cannot be hermetically sealed because of their design features.

Many locking plug receptacle designs employ pre-stressed contact assemblies which call for the application of substantial force to be interconnected with the plug prongs. In addition, such assembly of pre-stressed contact planar members with a male prong leads to excessive parts wear, especially when under a current load due to the heat of current arcing.

SUMMARY OF THE INVENTION

It is a goal of this invention to provide an electrical plug receptacle with a releasable lock catch mechanism that can be utilized in either an extension cord form or in standard wall sockets and the like.

It is a further object of this invention to provide a plug receptacle can lock and securely hold plugs of any type, whether of the two or three-prong variety, such that no particular modification or specific design is necessary in the plug prong members in order to have the plug receptacle of this device lock and engage the plug therein and when desired, release the plug by deliberate manual maneuvering, as described further below.

It is yet a further object of this invention to provide a plug receptacle that is not subject to wear by friction of the plug parts against interengaging members therewith since the plug parts of this invention engage with the normal contacts on both sides of the flat prong members of either a two or three-prong plug.

It is still a further object of this invention to provide a simplified mechanism for the locking of a plug within a plug receptacle that is convenient and easy to utilize and which can be incorporated into standard plug receptacles for use in wall sockets or alternatively utilized in extension cords or in any other place where plug receptacles are normally utilized.

DESCRIPTION OF THE PREFERRED EMBODIMENT(S)

Figures 1, 2, 3:
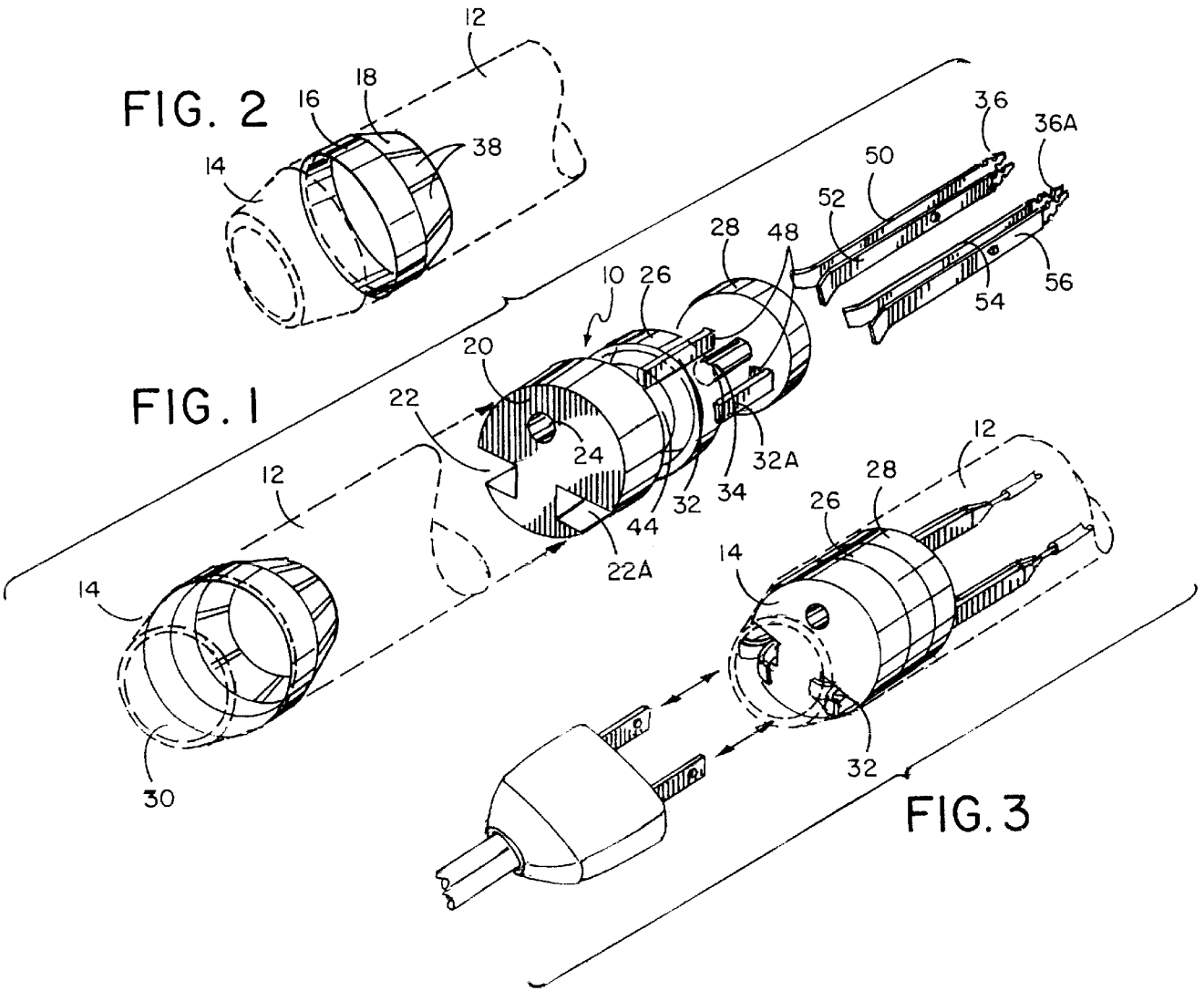
FIG. 1 illustrates a perspective exploded view of the interior elements of the plug receptacle of this invention.
FIG. 2 illustrates a perspective exploded view of the front tapered collar and sleeve collet of this invention.
FIG. 3 illustrates a perspective view of the interior elements of FIG. 1 assembled together.
Figure 4:
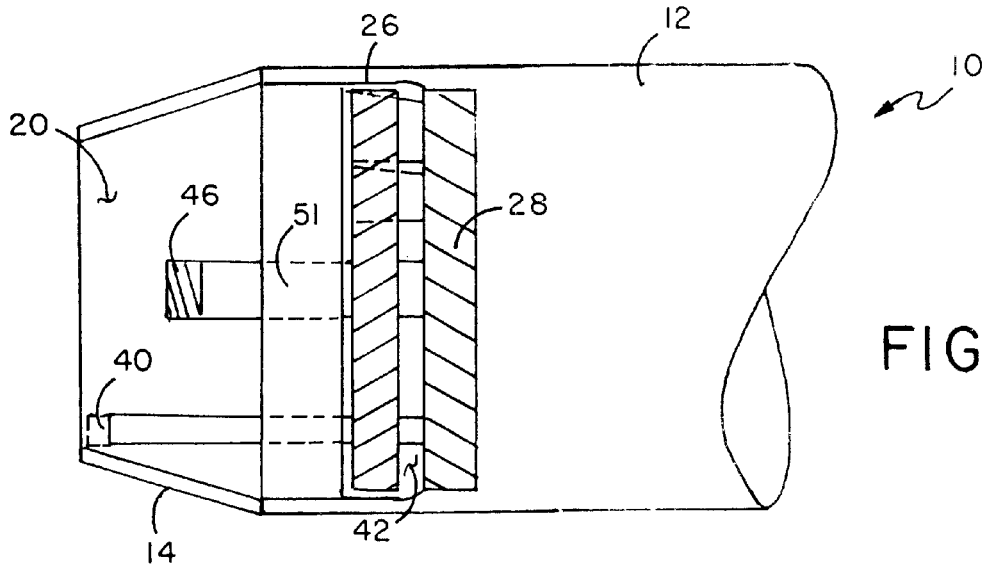
FIG. 4 illustrates an enlarged side view of the operation of the interior elements of the plug receptacle of this invention in a first unlocked position.

FIG. 1 illustrates the interior elements of the plug receptacle 10 of this invention. It should be noted that receptacle 10, although shown in elongated form within housing 12, can have its structure incorporated into an extension cord or can be incorporated within plug receptacles of wall sockets and the like. The locking mechanism, as described below, will function equally as well in both situations or in any other situation where a plug receptacle is to be used. The design shown herein is for receipt of either a two or three-pronged plug. The three-pronged plug has two parallel flattened prongs and a round prong centered thereabove which is quite familiar in structure although a two-pronged plug could be utilized without the rounded grounded prong. The structure incorporates a body 20 which has at its rear a cylindrically shaped recessed portion 44 which receives thereover a sliding slide ring 26. At the front of body 20 is a pair of flat prong receipt member and slide member receipt slots 22 and a round prong receipt hole 24 defined therein. A pair of first and second contacts 36 and 36*a*, which are each formed of two strips of metal, extend respectively through apertures 48 defined in slide support member 28 and pass through slide ring 26 into receipt slots 22 in body 20 and extend forward. First contact 36 is composed of first and second planar members 50 and 52 and second contact 36*a* is composed of third and fourth planar members 54 and 56. The ends of the planar members in first and second contacts 36 and 36*a* can flare outward to more easily receive the flat prongs of the plug therebetween, as best seen in FIG. 3. Slide support member 28 has extending forward from the center thereof a post member 34 which extends into aperture 51 defined in the rear of body 20, as best seen in FIG. 4, and compresses spring 46 within aperture 51. Attached to slide support member 28 is a pair of slide members 32 and 32*a* which extend through slide ring 26 and pass, respectively, adjacent to and against first and second contacts 36 and 36*a* within first and second receipt slots 22 and 22*a*. A tapered collar 14 passes over the front of body 20 such that when the inside of tapered collar 14 passes against the exterior of slide members 32 and 32*a*, the inside of tapered collar 14 forms an annular contact surface 30 which compresses slide members 32 and 32*a* tightly against first and second contacts 36 and 36*a*, respectively, forcing first and fourth planar members 50 and 56 inward. When a plug is in place between the planar members of each contact and body 20 moves forward within collar 14, the compression of slide members 32 and 32*a* against the exterior first and fourth planar members 50 and 56 of first and second contacts 36 and 36*a* compresses the planar members against the flat plug prong and retains the plug prongs securely in place. Attached at the rear of tapered collar 14 is sleeve 16 which has collet 18 extending rearwardly therefrom which has plurality of spring-like inwardly urging jaws 38 positioned thereon extending rearwardly such that as body 20 is moved back and forth within tapered collar 14 and housing 12, the jaws slide over and urge against the outer surface of slide ring 26 which can float in position on recessed portion 44 of body 20. When the plug prongs are inserted between first and second contacts 36 and 36*a*, the inward force also depresses and moves body 20 rearwards within housing 12.

Figure 5:
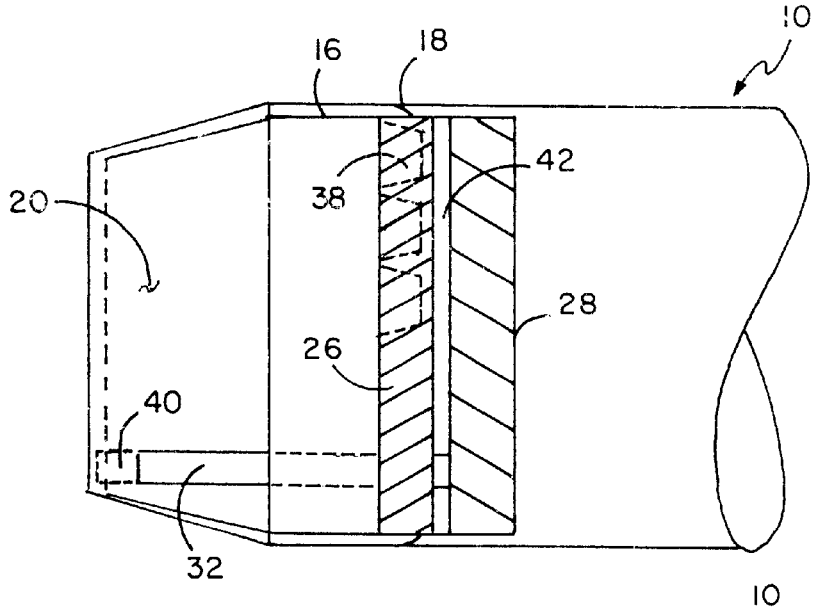
FIG. 5 illustrates an enlarged side view of the operation of the interior elements of the plug receptacle of this invention in a second transitional position.
Figure 6:
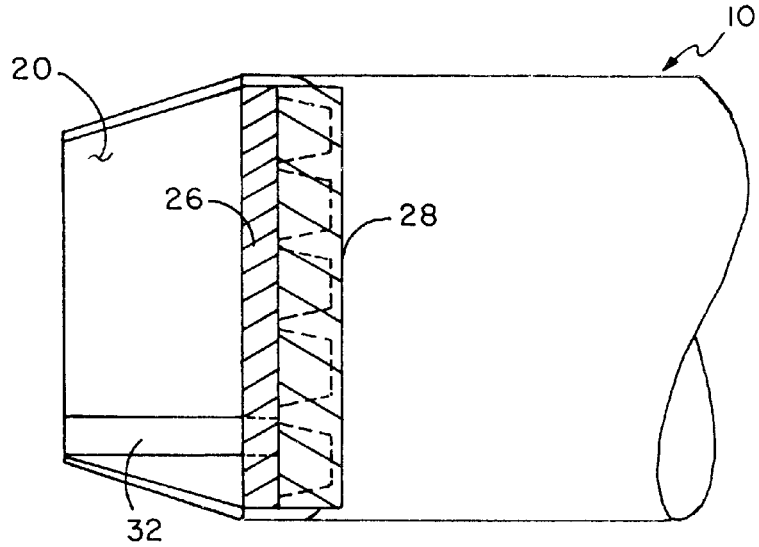
FIG. 6 illustrates an enlarged side view of the operation of the interior elements of the plug receptacle of this invention in a third locked position.

In FIG. 5 it can be seen that as body 20 is pushed rearward by the force of the plug insertion, jaws 38 of collet 18 move onto the exterior of slide ring 26. After releasing the plug, spring 46, seen in FIG. 4, urges body 20 forward and jaws 38 move rearward and urge within gap 42 then formed between moveable slide ring 26 and slide support member 28. This action stops the forward advance of body 20 before slide members 32 and 32*a* have been fully compressed by their being forced against annular contact surface 30 of tapered collar 14. In this mode the plug is free to be removed from the receptacle. When one then pushes the plug into the receptacle, jaws 38 ride up on slide ring 26 and as slide support member 28 closes against slide ring 28, slide support member 28 then passes underjaws 38 of collet 18, and body 20 is then forced by spring 46 much further forward as jaws 38 pass over closed gap 42 onto slide support member 28. Body 20 then moves forward within tapered collar 14, causing the inner annular contact surface 30 on the inside of tapered collar 14 to compress slide members 32 and 32*a* inward which action puts laterally inward pressure thereon within slide receipt areas 40, as seen in FIGS. 4 and 5, such that the compression on slide members 32 and 32*a* causes the contact members to squeeze tightly on the flat prongs of the plug and prevent the movement out of the receptacle by the plug so that the plug is securely retained within the receptacle.

When one wishes to release the locked plug from the receptacle, one forces the plug inward which action moves slide support member 28 rearward and opens gap 42 between slide support member 28 and slide ring 26 as slide ring 26, being movable in recessed portion 44 of body 20, is held from rearward movement by jaws 38 which action opens gap 42 between the slide support member and the slide ring into which gap 42 jaws 38 of collet 18 move, as seen in FIG. 4, and rest. Body 20 is then retained more rearwardly from the front of tapered collar 14 which position releases the lateral pressure of the annular contact surface 30 of tapered collar 14 against slide members 32 and 32*a*, thus allowing for easy release and pulling out of the plug from the receptacle.

It should be noted that although this structure has been illustrated being in a round form for usage at the end of an extension cord, the structural members can be not only round, but also can be rectangular or square and will still accomplish the same function. Moreover, the receptacle of this invention can be used and incorporated within the design of a socket receptacle for use in walls and the like. Each socket can be utilized in the same fashion as described above such that the plug can be inserted and because of the action of the interior elements, as described above, will lock the plug in place. When one desires to remove it, one does not pull on it but one pushes it inward and then because jaws 38 will urge within gap 42, body 20 is then held in a more rearward position which releases pressure on the prongs of the plug so that the plug can then be easily slid out of the receptacle. The process can be repeated over again for any number of insertions and removals. It should be noted that unless the plug is pushed inward before removal, it cannot be removed so that only that deliberate action can cause the removal of a plug. Thus the inadvertent pulling on the plug will not cause it to come out of the plug receptacle of this invention.

Although the present invention has been described with reference to particular embodiments, it will be apparent to those skilled in the art that variations and modifications can be substituted therefor without departing from the principles and spirit of the invention.

We claim:

1. A plug receptacle of the type to receive a plug with prongs, comprising:

means to receive the prongs of said plug in electrical contact;

means to apply lateral pressure against at least one of said prongs to retain it in position within said receptacle, said means including means to release said lateral pressure when desired wherein said means to apply lateral pressure include:

at least one contact member disposed to one side of one of said prongs;

means to move said contact member laterally against said prong;

a body having a front and a rear;

at least one prong receipt slot defined in said body;

at least one slide member disposed within said prong receipt slot adjacent to said contact member, said slide member when disposed in a first mode, applying lateral pressure against said contact member to apply pressure against said prong to retain said prong in said receptacle; and when said slide member is disposed in a second mode, ceasing to apply pressure against said prong, and allowing its removal from said receptacle; and a casing disposed around said body, said casing having a tapered collar, said tapered collar having an inner surface, said tapered collar having an annular seat disposed on said inner surface such that when said body moves forward within said collar member, lateral pressure is applied to said slide member.

2. The plug receptacle of claim 1 wherein said body has a recessed portion defined at the rear thereof;

said plug receptacle further including:

a slide ring disposed around said recessed portion;

a slide support member on which said slide member is positioned;

a sleeve member disposed around said body;

a plurality of inwardly urging jaw members attached to said sleeve member, forming a collet;

such that in a first mode said jaw members are engaged within a gap defined between said slide support member and said slide ring member, said body is disposed with said slide member not applying pressure to said contact member against said prong; and in a second mode when said plug has been pushed into said receptacle, said body is forced rearward and said jaws are forced onto the outer surface of said slide ring, and when pressure is released on said plug, said slide support member is allowed to move forward against said slide ring, closing said gap, and causing said jaws to pass over said gap and onto the exterior of said slide support, allowing said body to move forward within said tapered collar and applying pressure against said slide member which action applies pressure against said contact member to tighten against and retain said prong within said receptacle.

* * * * *